United States Patent [19]

Herb et al.

[11] 4,289,257

[45] Sep. 15, 1981

[54] DEVICE FOR MELTING A SOLID BODY OF ADHESIVE MATERIAL

[75] Inventors: Armin Herb, Peissenberg; Franz Popp; Hanspeter Ruoff, both of Munich, all of Fed. Rep. of Germany

[73] Assignee: Hilti Aktiengesellschaft, Schaan, Liechtenstein

[21] Appl. No.: 82,724

[22] Filed: Oct. 9, 1979

[30] Foreign Application Priority Data

Oct. 16, 1978 [DE] Fed. Rep. of Germany ..... 2844931

[51] Int. Cl.[3] ..... B67D 5/62

[52] U.S. Cl. ..... 222/146 HE; 222/391

[58] Field of Search ..... 222/146 HE, 391, 325, 222/146 R

[56] References Cited

U.S. PATENT DOCUMENTS 2,995,159 8/1961 Berggren ..... 141/82

3,743,142 7/1973 Elliott et al. ..... 222/146 HE 3,774,817 11/1973 Whittaker ..... 222/391 X

*Primary Examiner*—Stanley H. Tollberg

[57] ABSTRACT

In a device for melting a body of a solid thermoplastic adhesive material, a melting chamber is positioned within a housing and a feed apparatus moves the solid body in a step-wise fashion through the housing into the chamber. The feed apparatus includes a slidable carriage with a pair of separate clamping jaws within the carriage. A rocker lever is pivotally mounted on the housing and is articulated to the clamping jaws. When a trigger or pushbutton on the housing is pressed inwardly, it pivots the rocker arm and initially displaces the clamping jaws inwardly into clamping contact with the solid body and then moves the carriage, the clamping jaws and the clamping body toward the melting chamber.

8 Claims, 3 Drawing Figures

DEVICE FOR MELTING A SOLID BODY OF ADHESIVE MATERIAL

SUMMARY OF THE INVENTION

The present invention is directed to a device for melting a body of a solid thermoplastic material, and for effecting a dosed discharge of the molten material. The device includes a housing with a melting chamber and a feed apparatus located within the housing. The feed apparatus moves the solid body of adhesive material into the melting chamber and includes a sliding carriage with a clamping jaw arrangement supported within it. A trigger or pushbutton pivots a rocker lever which, in turn, actuates the feed apparatus for moving the solid body toward the melting chamber.

In the prior art there is a device for melting thermoplastic material which includes a carriage guided within longitudinal slots in a housing. A U-shaped bracket is rigidly connected to the carriage and serves as a support for the body of adhesive material being transported. On the side of the carriage opposite the bracket, a clamping jaw is pivotally mounted. A rocker lever engages the clamping jaw and pivots the clamping jaw when a pushbutton is pressed inwardly displacing the rocker lever. When a body of adhesive material is inserted into the device, it is pressed against the bracket by the clamping jaw and is rigidly fixed on the carriage. After the body of adhesive material is secured on the carriage, further actuation of the pushbutton displaces the entire carriage along with the clamping jaw and the body of adhesive material in the feed direction of the device. When the pushbutton is released, a spring swivels the rocker lever back to its starting position. This displacement of the rocker lever releases the clamping jaw from gripping engagement with the body of adhesive material. With the body of adhesive material released, the entire carriage including the clamping jaw and bracket is moved opposite to the feed direction. Accordingly, the bracket slides rearwardly over the body of adhesive material. This arrangement for feeding the solid body of adhesive material has a considerable number of drawbacks. Because of the sticky surface of the body of adhesive material and its relatively large contact surface with the bracket, it frequently happens that the body of adhesive material sticks to the bracket. As a result, during the return stroke of the carriage, the body of adhesive material is moved opposite to the feed direction. Accordingly, the solid body is completely or partially pulled out of the rear or inlet end of the melting chamber. Because of this withdrawal action, the solid body is no longer in sealed engagement with the melting chamber and molten material can leak from its inlet end. Almost immediately, the leaking molten material blocks the entire feed apparatus and renders the device inoperable. Furthermore, because of the contact between the carriage and the body of adhesive material, any cross sectional deviations in size or shape result in an eccentric positioning of the body of adhesive material relative to the inlet end of the melting chamber so that additional sealing problems are produced.

In another prior art device, serrated, spring loaded clamping jaws are used which grip and carry the body of adhesive material in the feed direction, but slide over the body of adhesive material when the jaws are moved opposite to the feed direction. Since the spring biasing effect acts on the clamping jaws during the return stroke, there is considerable resistance to the sliding movement of the jaws. Such sliding resistance can increase to such an extent that the body of adhesive material can be pulled rearwardly out of the melting chamber. Moreover, as the clamping jaws move rearwardly over the surface of the body of adhesive material during the return stroke, there is a tendency to damage the body which makes it difficult to seal effectively the inlet into the melting chamber.

Therefore, the primary object of the present invention is to provide a device for melting a solid body of adhesive material, such as a plastic material and to effect a dosed discharge of the molten material by providing a simple and reliable apparatus for feeding the body of adhesive material through the device.

In accordance with the present invention, two arcuately shaped and symmetrically arranged opposed clamping jaws are provided on a carriage, each clamping jaw is separate from the other and is articulated to the carriage by an arm engaged with a rocker lever.

The two movable clamping jaws effect a centralized gripping of the solid body of adhesive material independent of any possible deviations in the cross sectional shape and size of the body. Furthermore, there is the advantage gained by the use of two clamping jaws in that the release path of each jaw within the same clamping range conditions can be less than when a single clamping jaw and a stationary support is used. Both of the clamping jaws have a centering effect on the solid body of adhesive material. With the rocker lever in direct engagement with the actuator arm of each clamping jaw, it is assured that the clamping jaws are simultaneously actuated. Since the clamping jaws are not interconnected, they have individual mobility and cannot jam against one another.

To simplify the manufacturing of the clamping jaws, the actuator arms are each formed as an integral tab from the associated jaw with the tabs extending in the same axial region. With such an arrangement a low cost manufacturing process is afforded by punching the tabs or actuator arms out of the clamping jaws. After the tabs are punched out of the clamping jaws, an additional shaping of the tabs is provided in an embossing process. Accordingly, it is not necessary to weld, rivet or solder the actuator arms or tabs to the clamping jaws.

Based on its intended use, the surface of the body of adhesive material can vary greatly, for instance, the surface may be very sticky or very slidable. To prevent slipping of the clamping jaws relative to the surface of the body of adhesive material, the jaws are equipped with inwardly directed sharp-edged projections in the region of contact with the body. When the clamping jaws are displaced inwardly, the projections are pressed into the surface of the body of adhesive material. Due to the elasticity of the adhesive material, the surface of the body remains undamaged by the contact of the projections. During a return stroke of the feed apparatus, the clamping jaws are displaced outwardly out of contact with the surface of the body of adhesive material so that any deformation of the body does not impair the operation of the feed apparatus.

To avoid the application of unnecessary force in actuating the feed apparatus, it is advantageous to provide the carriage with longitudinal guides and to locate the actuator arms of the clamping jaws in the same plane or range or movement as the longitudinal guides. With this arrangement, because the force for moving the carriage of the feed apparatus is effective along the longitudinal guides, no interfering torque is produced on the carriage. Accordingly, it is possible to avoid any jamming produced by the action of the rocker lever moving the carriage along the longitudinal guides. Moreover, to avoid any interference placed on the carriage by the body of adhesive material, it is advantageous if the longitudinal guides are located in a plane extending through the longitudinal axis of the body of adhesive material. In this arrangement, the effective forces acting in the device are all directed in one plane and, since the clamping jaws are symmetrically arranged, no tilting of the longitudinal guides is possible.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2, 3:
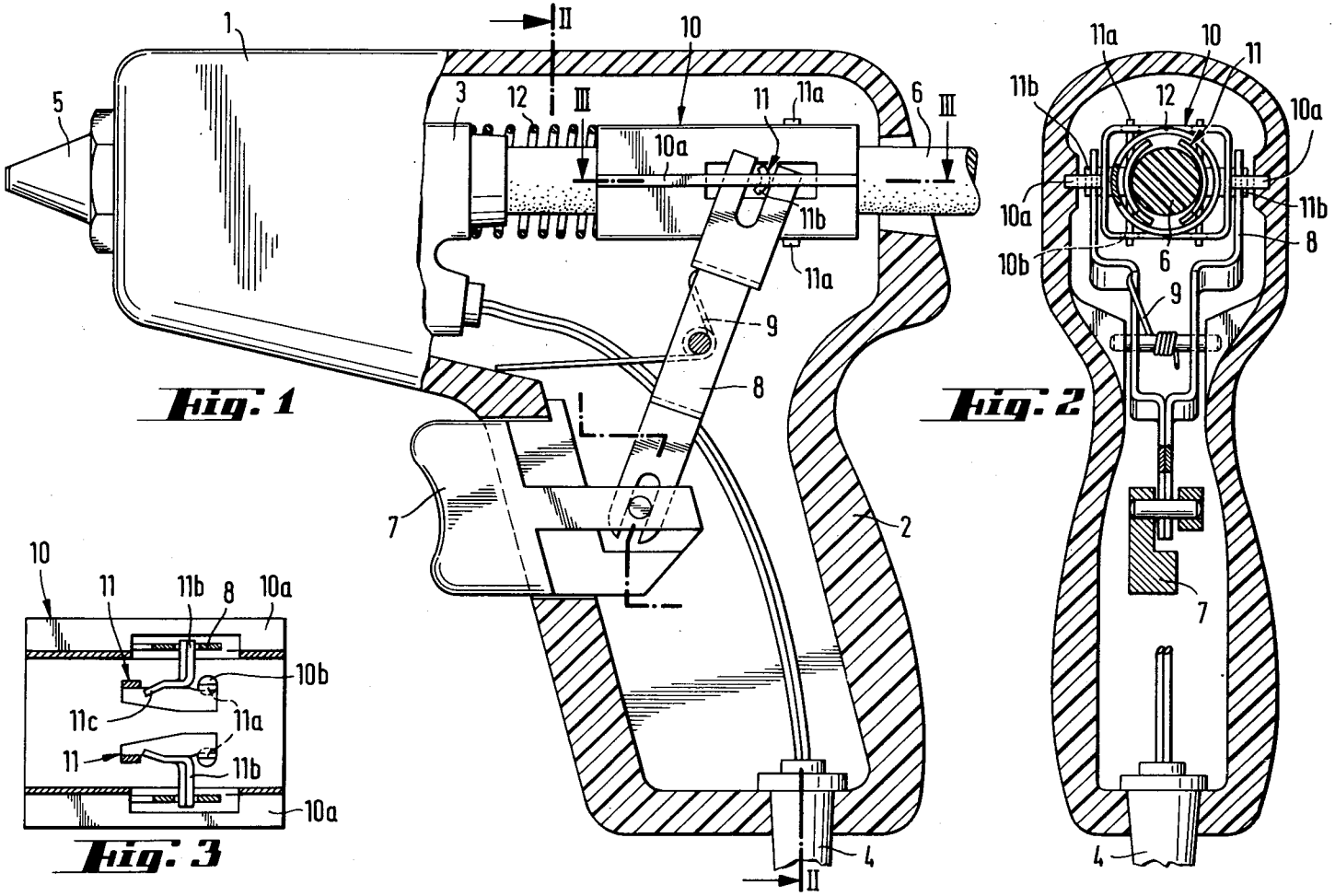
FIG. 1 is a side elevational view, partly in section, of a device embodying the present invention.
FIG. 2 is a sectional view taken along the line II—II in FIG. 1.
FIG. 3 is a sectional view of a portion of the device shown in FIG. 1 taken along the line III—III.

In FIG. 1 a device is illustrated for melting a solid body of thermoplastic adhesive material, and for effecting a dosed discharge of the molten material, and the device includes a hand gun-shaped housing 1 having a muzzle end and a rear end with a handle 2 extending downwardly from the rear end portion of the housing. In the housing 1, adjacent its muzzle end, the rear or inlet end of a melting chamber 3 is shown. The melting chamber 3 is electrically heated via a feeder line 4 which extends out through the bottom of the handle 2. Output nozzle 5, communicating with the melting chamber, is located on the muzzle end of the housing. A solid body 6 of an adhesive material is introduced into the housing through its rearward end. A feed apparatus, located between the inlet end of the melting chamber and the rear end of the housing, moves the body 6 in a step-wise fashion into the melting chamber 3. In the handle, a trigger or pushbutton 7 is articulated to a rocker lever 8 which is pivotally supported in the housing 1 at a position between the pushbutton and the feed apparatus. Spring 9 is positioned on the rocker lever and returns the rocker lever in the clockwise direction to its starting position after the trigger 7 has been pressed inwardly and then released. The feed apparatus comprises a carriage 10 slidably supported within the housing 1 and two separate clamping jaws 11 are pivotally supported within the carriage 10. When the trigger or pushbutton 7 is pressed inwardly, initially both clamping jaws are displaced by the rocker lever 8 inwardly into laterally clamping contact with the body of adhesive material. Subsequently, after the clamping action is effected, the carriage along with the clamping jaws 11 and the body 6 of adhesive material is axially displaced in the feed direction, that is toward the melting chamber 3 and the nozzle 5, acting counter to compression spring 12 laterally encircling the body 6 and extending between the inlet end of the melting chamber and the forward end of the carriage. When the trigger 7 is released, the rocker lever 8 is pivoted back to its starting position by the action of spring 9. This return movement of the rocker lever releases the clamping jaws from gripping contact with the body 6 of adhesive material, whereupon the compression spring 12 returns the carriage 10 and the clamping jaws 11 back to the starting position as shown in FIG. 1. In this return movement, since the clamping jaws are no longer in contact with the surface of the body 6 of adhesive material, the sliding resistance to the return movement of the carriage is kept at a minimum. The compression spring 12 effects the return movement of the carriage 10 independent of the position of the device.

In the cross sectional view afforded in FIG. 2, the box-shaped cross section of the carriage 10 can be noted. The box-shaped cross section includes an upper and lower side with a pair of upwardly extending sides extending between the upper and lower sides. A longitudinal guide 10*a* extends outwardly from each of the upwardly extending sides of the carriage 10 and fits into longitudinally extending grooves in the inner surfaces of the housing 1. Within the box-shaped carriage 10, the clamping jaws 11 are symmetrically arranged. The clamping jaws 11 are arcuately shaped so that each has a shell-like appearance with the inner surface of the jaw generally conforming to the surface of the solid body 6 of adhesive material. The symmetrical arrangement of the clamping jaws 11 can be appreciated in FIG. 2. Each clamping jaw has a tab 11*a* which engages the carriage 10, the tabs extend upwardly in the same direction of and spaced inwardly from the upwardly extending sides of the box-shaped carriage. Further, a tab-like actuator arm 11*b* extends outwardly from the outer surface of each of the clamping jaws through a rectangularly shaped slot in the carriage and is articulated with one of the arms of the rocker lever 8. As can be seen in FIG. 2, the upper portion of the rocker lever 8 is bifurcated providing an arm extending upwardly along the upwardly extending sides of the box-shaped carriage. The upper end of each arm of the rocker lever 8 is slotted and each actuator arm 11*b* extends into a different one of the rocker lever arms. The interconnection of the trigger 7 with the lower end of the rocker lever 8 can be seen in both FIGS. 1 and 2.

In FIG. 3 a sectional view is provided through the feed apparatus showing the oppositely disposed, symmetrically arranged clamping jaws 11. The clamping jaws are pivotally supported within the carriage 10. The upwardly extending tabs 11*a* of the clamping jaws 11 extend through openings 10*b* formed in the upper and lower sides of the box-shaped carriage 10. The holes in the upper and lower sides are aligned so that the tabs 11*a* extend through them. The tab-like actuator arms 11*b* bent out of the clamping jaws extend outwardly into engagement with the grooves formed in the upper ends of the arms of the rocker lever 8. It can be noted in FIG. 1 that the actuator arms 11*b* have a curved shape. In the region of the inner surfaces of the clamping jaws 11 which contact the surface of the solid body 6 of adhesive material, sharp-edged projections 11*c* extend inwardly from the clamping surfaces so that when the clamping jaws are displaced inwardly by the pivoting action of the rocker lever 8, the projections 11*c* grip or bite into the surface of the body 6 and prevent possible slippage of the clamping jaws 11 relative to the body.

When the trigger 7 is pressed into the handle 2 of the housing 1, the rocker lever 8 is pivoted counterclockwise so that its upwardly extending arms, in engagement with the actuator arms 11*b* of the clamping jaws 11 move toward the melting chamber 3. It can be noted in FIG. 3 that the arms of the rocker lever 8 extend through cutout portions of the longitudinal guides 10*a* so that a certain initial movement of the rocker lever is possible before the carriage is displaced. During this initial movement, the engagement of the tabs 11*a* in the openings 10*b* in the carriage 10 cause the separate clamping jaws 11 to pivot inwardly into contact with the body 6 with the projections 11*c* biting into the surface of the body of adhesive material. After the rocker lever has displaced the clamping arms into gripping contact with the body 6 of adhesive material, the rocker lever moves the carriage along with the clamping jaws toward the melting chamber guided by the longitudinal guides 10*a* so that the box-shaped carriage and the body 6 all move along the same longitudinal axis. When the rocker lever has completed its counterclockwise movement pushing the carriage forwardly and moving the solid body 6 of adhesive material into the inlet end of the melting chamber 3, upon release of the trigger 7, the rocker lever returns to the position shown in FIG. 1. This return action releases the clamping jaws from gripping contact with the solid body 6 so that the spring 12 can bias the carriage 10 along with the clamping jaws 11 rearwardly out of contact with the body 6. Accordingly, there is no tendency of the feed apparatus to pull the solid body 6 backwardly out of the inlet end of the melting chamber 3 which would tend to break the seal between the body of adhesive material and the inlet into the chamber. Each time the solid body 6 is moved forwardly into the melting chamber 3, as long as the melting chamber is filled, there is a dosed discharge from the nozzle 5. The amount of molten adhesive material discharged each time, that is the dosed discharge, can be regulated by controlling the movement of the rocker lever and, as a result, the axial distance travelled by the feed apparatus in moving the body 6 into the melting chamber.

While specific embodiments of the invention have been shown and described in detail to illustrate the application of the inventive principles, it will be understood that the invention may be embodied otherwise without departing from such principles.

What is claimed is:

1. Device for melting a body of thermoplastic adhesive material and for effecting a dosed discharge of the molten material comprising a housing having a first end from which the molten material is discharged and a second end through which a solid body of the adhesive material is introduced into the housing, a melting chamber within said housing for supplying molten material for discharge from the first end of said housing, a feed apparatus within said housing between said melting chamber and the second end of said housing for stepwise feeding the solid body of adhesive material into the melting chamber, said feed apparatus including a carriage slidably mounted in said housing for movement in the direction between the first and second ends of said housing, a clamping device located within said housing and displaceable between a release position out of engagement with the solid body of the adhesive material and a holding position in clamping engagement with the solid body of adhesive material, a rocker lever pivotally mounted in said housing and disposed in engagement with said feed apparatus for displacing said clamping device into the holding position and for moving said feed apparatus, and means on said housing for pivoting said rocker lever, the improvement comprising that said clamping device includes a pair of symmetrical oppositely disposed clamping jaws, each said clamping jaw being articulated to said carriage, and an actuating arm attached to each said clamping jaw and in engagement with said rocker lever so that when said means pivot said rocker lever said clamping jaws are displaced into the holding position in clamping engagement with the body of adhesive material and said feed apparatus is displaced toward the first end of said housing, each said clamping jaw includes said actuating arm formed integrally with said clamping jaw and formed therefrom in a tab-like manner extending laterally outwardly away from the other said clamping jaw, and said arm being articulated to said rocker lever, each said clamping jaw includes a sharp-edged projection extending laterally inwardly from said clamping jaw toward the other said clamping jaw for engaging into the surface of the solid body for assuring gripping contact with the solid body when it is moved toward said melting chamber, said feeding apparatus includes a longitudinal guide secured to and extending outwardly from each of the opposite sides of said carriage, said housing having grooves therein into which said longitudinal guides project for guiding said feeding apparatus in the movement thereof between the first and second ends of said housing.

2. Device, as set forth in claim 1, wherein the inwardly facing surfaces of said clamping jaws facing one another have a shaped configuration conforming generally to the shape of the surface of the solid body of adhesive material.

3. Device, as set forth in claim 1, wherein said carriage being box-shaped in section extending transversely of the direction between the first and second ends of said housing.

4. Device, as set forth in claim 3, wherein said box-shaped carriage having a pair of first sides with one said first side located above said clamping jaws and the other said first side located below said clamping jaws, a pair of second sides each located laterally outwardly from a different one of said clamping jaws and extending between said first sides, openings extending through each of said first sides with each of said openings in the upper one of said first sides being aligned with one of the openings in the lower end of said first sides, and a tab is formed on each said clamping jaw and each said tab extending through a pair of aligned openings in said sides.

5. Device, as set forth in claim 4, wherein said rocker lever being bifurcated in the region between the pivotal attachment thereof to said housing and said box-shaped carriage and providing a pair of laterally spaced rocker lever arms, and each of said arms being located laterally outwardly from a different one of said second sides.

6. Device, as set forth in claim 5, wherein each said rocker lever arm having a slot therein and said arm of one of said clamping jaws being articulated to one of said rocker lever arms within said slot.

7. Device, as set forth in claim 6, wherein said clamping jaws and said arms thereon being symmetrically arranged relative to the longitudinal guides of said carriage.

8. Device, as set forth in claim 7, including first spring means for returning said rocker lever to the starting position after moving the feed apparatus toward said melting chamber and second spring means for returning said feed apparatus toward the second end of said housing after the feed apparatus has been moved toward said melting chamber by said rocker lever.

* * * * *